US006983807B2

(12) United States Patent
Mayr et al.

(10) Patent No.: US 6,983,807 B2
(45) Date of Patent: Jan. 10, 2006

(54) ELECTRICAL, ROTARY-PERCUSSION HAND-HELD TOOL

(75) Inventors: Martin Mayr, Ilmmunster (DE); Wolfgang Zwerenz, Landsberg (DE); Walter Wissmach, Munich (DE); Christoph Kink, Stadtbergen (DE)

(73) Assignee: Hilti Aktiengesellschaft, Schaan (LI)

( * ) Notice: Subject to any disclaimer, the term of this patent is extended or adjusted under 35 U.S.C. 154(b) by 25 days.

(21) Appl. No.: 10/651,743

(22) Filed: Aug. 29, 2003

(65) Prior Publication Data

US 2004/0112615 A1 Jun. 17, 2004

(30) Foreign Application Priority Data

Sep. 2, 2002 (DE) ..... 102 40 361

(51) Int. Cl.
*B25D 16/00* (2006.01)

(52) U.S. Cl. ..... 173/48

(58) Field of Classification Search ..... 173/2, 173/5, 6, 176, 178, 48, 217, 170, 109, 216, 173/201

See application file for complete search history.

(56) References Cited

U.S. PATENT DOCUMENTS 4,650,375 A * 3/1987 Millsap ..... 408/9
4,998,588 A * 3/1991 Manschitz ..... 173/47
5,056,607 A * 10/1991 Sanders ..... 173/48
5,357,179 A * 10/1994 Abbagnaro et al. ..... 318/17
5,868,208 A * 2/1999 Peisert et al. ..... 173/178
5,996,707 A * 12/1999 Thome et al. ..... 173/2
6,109,364 A * 8/2000 Demuth et al. ..... 173/48
6,484,814 B2 * 11/2002 Bongers-Ambrosius ..... 173/2
6,550,545 B1 * 4/2003 Manschitz et al. ..... 173/48
6,725,944 B2 * 4/2004 Burger et al. ..... 173/48
6,766,868 B2 * 7/2004 Frauhammer et al. ..... 173/48

FOREIGN PATENT DOCUMENTS

DE 102 25 239 * 6/2002

* cited by examiner

*Primary Examiner*—Scott A. Smith

(74) *Attorney, Agent, or Firm*—Abelman, Frayne & Schwab

(57) ABSTRACT

An electrical, rotary-percussion hand-held includes a spindle (4), an electric motor for driving the spindle at different rotational speeds corresponding to different operational modes, a percussion mechanism and a gear mechanism arranged between the electric motor (1) and the spindle (4) for transmitting a drive torque from the electric motor (1) to the spindle (4), and a rotation shifting device (7) operatively connected with signal elements (6, 6') and electrically connected with the electric motor (1) for driving the spindle (4) with a rotational speed corresponding to a selected operational mode.

4 Claims, 1 Drawing Sheet

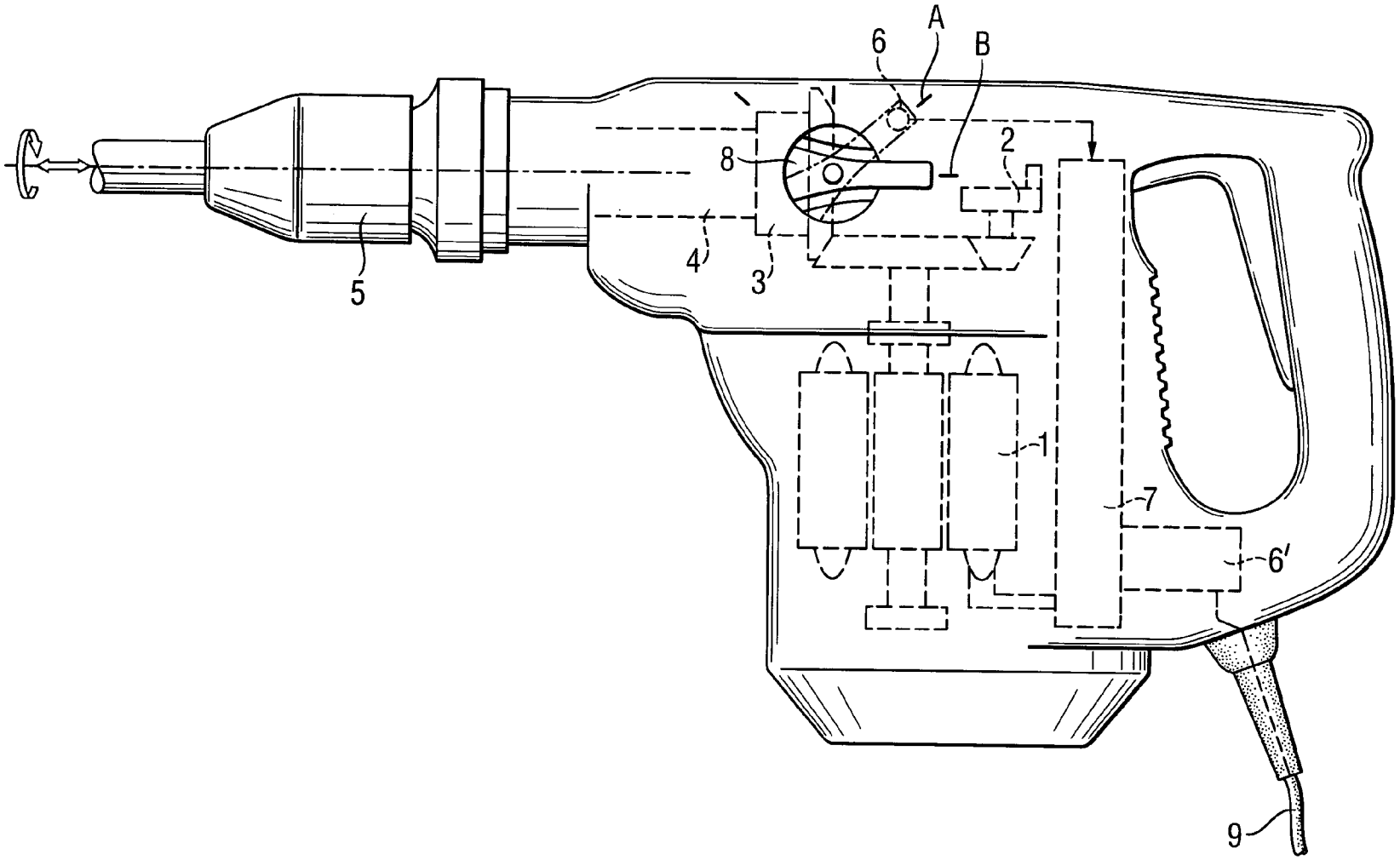
A
B
1
2
3
4
5
6
6'
7
8
9

ELECTRICAL, ROTARY-PERCUSSION HAND-HELD TOOL

BACKGROUND OF THE INVENTION

1. Field of the Invention

The present invention relates to an electrical, rotary-percussion hand-held tool, in particular, to a combi-hammer or a chisel hammer with positioning of a chisel.

2. Description of the Prior Art

When a pure percussion working tool such as, e.g., a flat chisel, is used, the axial rotation represents a degree of freedom of movement which at a corresponding use, usually, is interrupted, in advance of chisel position, by stopping the rotation as a result of the rotational shift.

German Publication DE-198 45 846 discloses a percussion electrical hand-held tool in which a mechanical mechanism for a manual, rotation shifting fixation of a chisel is provided on the chuck. The manual rotational positioning of the chisel is effected with a passive, non-operating, electrical, rotary-percussion, hand-held tool.

German Publication DE-100 31 050 A1 discloses a combination, electrical hand-held tool having an operational mode "chisel positioning" to which the tool is switched by a rotational switching, mode selection switch. In this tool, at the operational mode "chisel positioning", the chuck, which is provided on the spindle, is freely rotatable for positioning of a chisel. In the operational mode "chisel," the tool spindle is fixed adjacent to this rotational position. For rotationally positioning the chisel, the tool should be switched in advance in the passive operational mode "chisel positioning." Only then, the chisel is manually positioned, with the tool being subsequently switched in the operational, mode "chisel." This sequence requires several operations by the user.

Accordingly, an object of the present invention is to provide an electrical, rotary-percussion, hand-held tool with a convenient positioning of a percussion working tool.

SUMMARY OF THE INVENTION

This and other objects of the present invention, which will become apparent hereinafter, are achieved by providing an electrical, rotary-percussion hand-held tool including a spindle having a chuck for receiving a working tool, an electric motor for driving the spindle between alternatingly switchable modes, a percussion mechanism and a gear mechanism arranged between the electric motor and the spindle for transmitting a drive torque from the electric motor to the spindle, and rotation shifting means operatively connected with signal means and electrically connected with the electric motor for actively shifting rotation of the spindle.

According to the present invention, the rotation shifting means, which controls, together with the signal means, the drive motor, provides for active rotation shifting of a rotational position of the spindle and, thereby, of a working tool, which is fixedly received in the tool spindle, in at least one alternatively selectable operational mode of the rotary-percussion tool. The rotation shifting is effected with a rotational angle of less than 360° which is obtained within a limited, controllable by a user, time period between 0.3 and 30 sec as a result of slow rotation.

Advantageously, the rotation shifting means is formed as motorelectronics that provides for a slow rotational movement of the electric motor suitable for effecting switching of rotation of the spindle. The rotation shifting means is realized with a motor controlling algorithm for a slow rotational movement, e.g., with synchronization of motor phases in a range between 1 and 10 Hz.

Advantageously, the signal means is actively connected with a mode selection switch for selecting an operational mode via at least one switching position. Thereby an active operational mode of the rotary-percussion tool is manually selected for rotation shifting of the spindle. In particular, an operational mode "active chisel shifting" is selected as the connecting switching position movement of the mode selection switch, immediately adjacent to an exclusively percussion operational mode. Thereby, a direct switching between operational modes "chisel" and "active chisel positioning" becomes possible.

Advantageously, the at least one connecting switching position is not a self-locked position. Thereby, a prolonged use of this operational mode for any other purpose becomes more difficult.

Advantageously, the signal means is formed alternatively or in combination as a voltage sensor arranged in an electrical circuit that connects the electric motor with a network line. Thereby, maintenance work can be conducted in slow movement mechanical region of the rotary-percussion tool over a predetermined voltage range, e.g., below 50V.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a rotary-percussion electrical hand-held tool according to the present invention.

DETAILED DESCRIPTION OF THE PREFERRED EMBODIMENT

A rotary-percussion tool according to the present invention, which is shown in the drawings, includes an electrical motor 1, a percussion mechanism 2, and a gear mechanism 3 for transmitting a torque to a spindle 4 at a free end of which a chuck 5 is provided. The electrical motor 1 can drive the spindle 4, via the percussion mechanism 2 and the gear mechanism 3, alternatively in rotational and/or percussion mode. The rotary-percussion tool further includes rotation shifting means 7 which is operatively connected with signal means 6 and is electrically connected with the electric motor 1. The rotation shifting means 6 is formed a motor electronics with synchronization of motor phases in the range between 1 and 10 Hz for an active shifting of rotation of the spindle 4. The signal means 6, which is formed as Hall-sensor, is connected with a mode selection switch 8 for selecting an operational mode. The signal means 6 is connected with mode selection switch 8 via a switch position A, "active chisel positioning." The switch position A is located, within a positive switching sequence determined by the degree of freedom of movement of the mode selection switch 8, immediately adjacent to an operational mode B-chisel, without being automatically or self-locked in this position. The rotary-percussion tool further includes signal means 6' formed as a voltage sensor and arranged in an electrical circuit that connects the electric motor 1 with a network line 9.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An electrical, rotary-percussion hand-held tool, comprising a spindle (4) having a chuck (5) for receiving a working tool; an electric motor (1) for driving the spindle (4) at different rotational speeds corresponding to different operational modes; a percussion mechanism (2) and a gear mechanism (3) arranged between the electric motor (1) and the spindle (4) for transmitting a drive torque from the electric motor (1) to the spindle (4); a mode selection switch (8) for selecting an operational mode and having a plurality of stable, self-locked switching positions corresponding to the different operational modes; signal means (6, $6^1$) operatively connected with the mode selection switch (8) in a switch position (A) thereof corresponding to an activated chisel positioning mode in which the mode selection switch (8) is in an unstable position; and rotation shifting means (7) operatively connected with signal means (6, $6^1$) and electrically connected with the electric motor (1) for changing a rotational speed of the electric motor for driving the spindle (4) with a rotational speed corresponding to the selected operational mode.

2. An electrical, rotary-percussion, hand-held tool according to claim 1, wherein the rotation shifting means (7) is formed as motor electronics that provides for a slow rotational movement of the electric motor (1) suitable for changing switching of rotation of the spindle (4).

3. An electrical, rotary-percussion, hand-held tool according to claim 1, wherein the switch position (A) corresponding to an active chisel position is located immediately adjacent to an exclusively percussion operational mode at which a chiseling operation takes place.

4. An electrical, rotary-percussion, hand-held tool according to claim 1, wherein the signal means (6, $6^1$) comprises a voltage sensor (6, $6^1$), arranged in an electrical circuit that connects the electric motor (1) with a network line (9).

* * * * *